US006763898B1

(12) United States Patent
Roodenburg et al.

(10) Patent No.: US 6,763,898 B1
(45) Date of Patent: Jul. 20, 2004

(54) DUAL HOIST SYSTEM

(75) Inventors: Joop Roodenburg, Delft (NL); Adriaan Jan Roodenburg, Rotterdam (NL); Johannes Jozef Zwetsloot, Rotterdam (NL)

(73) Assignee: ITREC B.V. (NL)

( * ) Notice: Subject to any disclaimer, the term of this patent is extended or adjusted under 35 U.S.C. 154(b) by 0 days.

(21) Appl. No.: 10/213,311

(22) Filed: Aug. 6, 2002

(51) Int. Cl.[7] ..... E21B 15/02

(52) U.S. Cl. ..... 175/7; 166/358; 175/122; 175/162

(58) Field of Search ..... 175/5, 7, 122, 175/162; 166/352, 358, 338

(56) References Cited

U.S. PATENT DOCUMENTS

| | | | | |
|---|---|---|---|---|
| 4,744,710 A | | 5/1988 | Reed | 414/22 |
| 4,762,185 A | | 8/1988 | Simpson | 175/5 |
| 5,647,443 A | | 7/1997 | Broeder | 175/5 |
| 6,048,135 A | * | 4/2000 | Williford et al. | 405/196 |
| 6,085,851 A | | 7/2000 | Scott et al. | 175/7 |
| 6,217,258 B1 | | 4/2001 | Yamamoto et al. | 405/201 |
| 6,581,698 B1 | * | 6/2003 | Dirks | 175/52 |

FOREIGN PATENT DOCUMENTS

| | | |
|---|---|---|
| EP | 0979924 A2 | 2/2000 |
| GB | 2 041 836 | 9/1980 |
| GB | 2 291 664 | 1/1996 |

* cited by examiner

*Primary Examiner*—Hoang Dang
(74) *Attorney, Agent, or Firm*—Wendy Buskop; Buskop Law Group, P.C.

(57) ABSTRACT

The invention is a multiple lift hoist system for a drilling vessel and use on land made of a mast with a top side and a base connected to a drilling vessel, wherein the mast has a hollow construction for supporting a first and second hoisting device at the top side, a lift system with a first hoisting device located in a first firing line that manipulates a first drill string and s second hoisting device located in a second firing line that manipulates a second drill string both hoisting devices move the strings in the longitudinal direction of the mast, and a plurality of cables and winches disposed in the hollow construction to manipulate the position of the first and second hoisting devices relative to the mast so the first and second firing lines are accessible from the outside of the mast.

47 Claims, 8 Drawing Sheets

DUAL HOIST SYSTEM

FIELD OF THE INVENTION

The present invention relates to a drilling mast for a drilling vessel, for drilling in the ground, for example for oil or gas, by means of the drilling mast, which drilling mast at the top side is provided with first hoisting means in a first firing line, for manipulating a first object, such as a drill string, in the longitudinal direction of the mast, and with second hoisting means in a second firing line, for manipulating the position of a second object, such as a second drill string, in the longitudinal direction of the mast.

BACKGROUND OF THE INVENTION

It is known in the prior art to drill from a drilling vessel, for example for oil or gas. A drilling vessel that is used for this application is known from British Patent Application GB 2291664 A.

Drilling from such a vessel is carried out with a drilling tool fixed on the end of a drill string. The drill string is composed of loose drill string elements. The drill string elements consist mainly of a piece of pipe, which is provided on either side with fixing elements for connecting together adjacent pipes.

During the drilling, the drilling tool is guided in the direction of the seabed by means of the drill string. A new drill string element is constantly added to the drill string at the top, so that the drilling tool can extend ever further in the direction of the seabed. Assembling such a drill string takes a relatively long time, despite the fact that the drill string can move freely through the water. Another factor is that the greater the depth to which drilling has to be carried out, the more time is needed for assembling the drill string and for moving the drilling tool in the direction of the seabed. During drilling, a drilling tool inevitably becomes blunt. That means that the drilling tool has to be replaced by a new, sharp tool. In order to be able to raise the worn tool, the drill string has to be hoisted up in its entirety. During the hoisting operation the drill string is disassembled. This hoisting up of the drill string, including drilling tool, also takes a relatively long time.

In order to prevent a great deal of time from being lost in assembling or dismantling a drill string, it is advantageous to have first and second hoisting means available next to each other for the purpose of installing below them a first and a second drill string respectively. During the disassembly of the drill string to replace the tool, it is possible to make a start on the assembly of a new drill string with a new tool on it.

U.S. Pat. No. 6,085,851 discloses a drilling tower that has below it a first and second hoisting means above a first and second firing line respectively. The first and second hoisting means can be used simultaneously. The drilling tower according to U.S. Pat. No. 6,085,851 is constructed as a lattice structure. The mast is in the shape of a narrow high pyramid with the top cut off. The hoisting means and the firing lines are inside this lattice structure, which means that the hoisting means and the firing lines are separated from the outside world by the lattice structure. The hoisting means and the firing lines are therefore difficult to reach from the outside, which is a disadvantage.

A so-called setback is used during the drilling process. This setback is a temporary storage of drill string elements on a ship. During the assembly and the dismantling of a drill string, so-called multi-joints can be set in a setback. Multi-joints are units of two or more drill string elements each, which can be held in storage in the vertical position in the setback. From the setback the drill string elements can be supplied in multi-joints to the firing line. Since the firing lines of the drilling mast according to U.S. Pat. No. 6,085,851 are difficult to reach from the outside of the mast, the setbacks have to be placed in the lattice structure. In order to use the two firing lines simultaneously, two setbacks even have to be present in the lattice structure. That is a disadvantage, for the simple reason that little space is available in the lattice structure itself.

Certainly if work is being carried out at fairly great depth, it must be possible to feed in drill string elements to the firing lines from the outside of the drilling mast. Since the firing lines are screened off by the lattice structure, complex handling tools are necessary for this purpose, which is a disadvantage.

SUMMARY OF THE INVENTION

The invention is a multiple lift hoist system for a drilling vessel made of a hollow mast connected to a drilling vessel. The mast supports the hoisting devices. The lift system contains hoisting devices located in firing lines to manipulate a drill strings in a direction longitudinal to the mast. Cables and winches located in the mast position the hoisting devices relative to the mast so the firing lines are accessible from the outside of the mast.

The invention also contemplates the same multiple lift hoist system described above for use.

The invention is a method for lifting equipment with a multiple lift hoist tower. Hoisting devices manipulate drill strings in a direction longitudinal to the mast. The cables and winches located within the hollow mast position the hoisting devices so the hoisting devices are accessible from the outside of the mast. The invention contemplated that between 2 and 6 hoisting devices can be used.

The invention is also a method for installing tubing for a well. Loose tubulars are first loaded into container then placed on a barge. The tubular support includes numerous connectors attached to each end of the container for lifting and locking containers together. The method involves moving the barge to a drilling rig, placing the containers on the drilling rig, and connecting the containers together with connectors making a container assembly. The method continues by connecting a first tubular in a first container to a second tubular in a second container for each assembly. The method ends by moving the container assemblies to the lifting positions next to the firing line, lifting the container assemblies with the connected tubulars to a vertical position, and removing individual connected tubulars from the container assembly for running into the well using the pipe racking cranes while simultaneously lowering the container assemblies for storage.

BRIEF DESCRIPTION OF THE DRAWINGS

The present invention will be explained in greater detail with reference to the appended figures, in which.

DETAILED DESCRIPTION OF THE PREFFERED EMBODIMENTS

Figure 1:
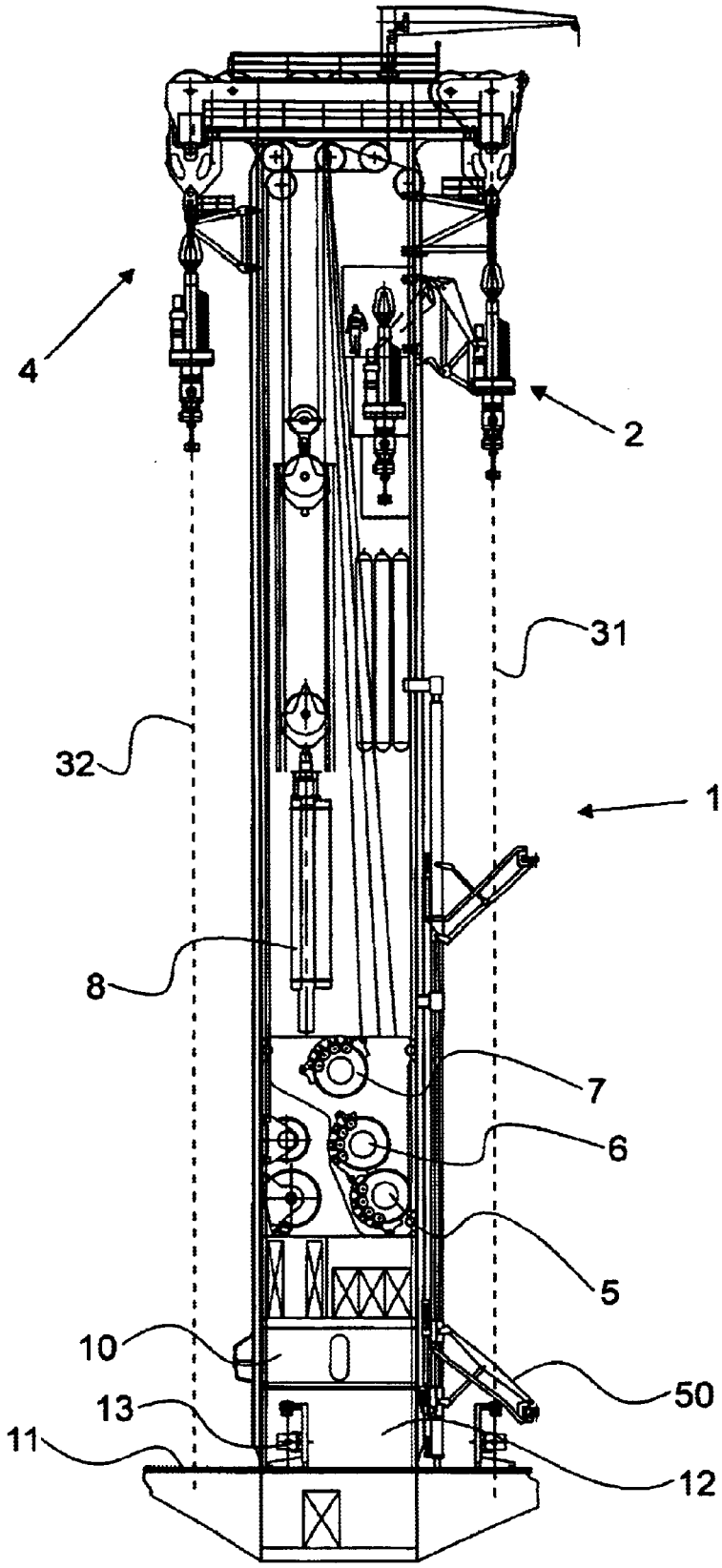
FIG. 1 shows a side view of a drilling mast according to the present invention.

It is the object of the present invention, in view of the disadvantages of the prior art, to provide a drilling mast by means of which effective use can be made of both a first and a second firing line, while the disadvantages of the prior art are avoided as far as possible.

That object is achieved in the present invention by the fact that the drilling mast is in the form of a tube or sleeve with substantially hollow inside, for accommodating therein means, such as winches and cables, for manipulating the position of the first and the second hoisting means relative to the mast, in order in that way to make the first and the second firing line accessible from the outside of the drilling mast.

Each of the hoisting means on the drilling mast according to the invention will be connected to at least one winch for moving the hoisting means up and down relative to the mast. Furthermore, the hoisting means can be connected to a heave compensation system. For a detailed description of a suitable heave compensation system, reference is made to the not yet published international patent application PCT/NL00/00276, in the name of the same applicant. It is pointed out that, by means of a reference, the content of this application forms part of the description of the present invention.

Through the chosen construction, in which the mast forms a tube with space on the inside, all the necessary control elements of the hoisting blocks can be accommodated in the mast itself. That means that the hydraulic lines, the motors, the winches, the cylinders for the heave compensation system and the like are all accommodated in the mast. A great deal of precious space is consequently kept free on deck of the ship. Since the control elements of the hoisting blocks are accommodated in the mast itself, the outside of the mast is very easy to reach. The accessibility of the mast is not restricted by a lattice structure, as in the case of U.S. Pat. No. 6,085,851 discussed above. Moreover, there are no cables, lines or other obstacles, which restrict the accessibility.

The drilling mast according to the invention also has advantages during its production. It is possible to assemble and test a complete mast, provided with all the necessary parts. Only when the mast appears to be in order it is transported in its entirety to the ship on which the mast is to be placed. With drilling towers according to the prior art that is not possible.

It is advantageous according to the invention for the mast to be of a substantially quadrangular design, the first and the second hoisting means being fixed on opposite sides of the mast.

It is possible according to the invention to place beside the drilling mast at least a first and a second set-back for the accommodation of elements, such as multi-joints, at least a first piperacker being provided beside the drilling mast, for moving elements from the first set-back to the first firing line, or vice versa, and a second piperacker being provided, for moving elements from the second set-back to the second firing line, or vice versa. It is further advantageous here for a third piperacker to be placed beside the drilling mast, for moving elements from the first set-back to the second firing line, or vice versa, and a fourth set-back, for moving elements from the second set-back to the first firing line, or vice versa.

The use of piperackers is known from the prior art. The piperackers can manipulate the drill string elements in the vertical position, in order to supply them to the mast or to permit them to be removed to the setback. Making use of two rotating setbacks, each on one side of the drill mast, ensures that drill string elements can be supplied and removed both at the first and at the second hoisting means.

If use is made of a first and a second rotating set-back, each provided with two piperackers, it can be ensured that drill string elements can be supplied from a single rotating set-back to both the first and the second hoisting means. If one of the piperackers fail, this arrangement ensures that drill string elements can be supplied to and removed from the first and the second hoisting means at all times.

The invention further relates to a drilling mast which is provided with a set-back, the set-back comprising a substantially vertically placed holder, which is provided so that it rotates about a substantially vertical rotary shaft, the holder being provided with pick-up elements, extending in a substantially horizontal direction, which pick-up elements are designed for suspending an element, such as a multi-joint, from them.

As already stated, it is known according to the prior art to make use of a temporary storage of drill string elements in a so-called setback. Normally speaking, relatively complex support means are needed for introducing the drill string elements into and withdrawing them from the setback. By now designing the set-back in the form of a rotating element, it is possible for the position from which a drill string element has to be picked up by a conveyor means and the position in which a drill string element can be left behind in the set-back by a conveyor means to remain constant during use. When a drill string element has been removed from the setback, the setback can be rotated in order to set a subsequent drill string element ready at the same position.

According to the invention, it is advantageous as regards the setback for the pick-up elements to be in the form of fingerboards with a substantially closed inner core, on which outward projecting fingers are provided. It is possible here for the set-back to comprise a top fingerboard with substantially saddle-shaped openings, which are accessible from the outside of the fingerboard, in order to limit in two directions a part of an element, such as a multi-joint, suspended in the fingerboard. It is further possible for the setback to comprise a bottom fingerboard, in which openings are provided in order to accommodate an element, such as a multi-joint, in an enclosing manner in the openings. It is possible here for the setback to have a middle fingerboard with substantially straight openings, which are accessible from the outside, for guiding an element, such as a multi-joint, in the horizontal direction.

It is advantageous to be able to retain a drill string element in the setback with as few moving parts as possible. If loose shut-off elements have to be used for locking the drill string elements in the setback, additional operations are necessary. In that case it takes more time to put away and fetch a drill string element. According to the invention, a facility is provided for supplying a drill string element in the vertical position from the outside to the rotating setback. In the hoisted state a substantially open holder of the middle fingerboard and the holder of the top fingerboard receive a drill string element. A drill string element can subsequently be moved downwards making use of the guide of these two open fingerboards. An opening that can limit the movement of a drill string element in the horizontal direction is provided in the bottom fingerboard. A saddle-shaped construction is provided in the top fingerboard, in which construction a part of the drill string element can be received. The saddle-shaped construction also ensures that the drill string element cannot move in the horizontal direction at the topside, under the force of gravity. In this way it is ensured by means of the top, bottom and middle fingerboard that a drill string element is held securely in the fingerboard, without use being made of moving locking parts. The guided constructions are exchangeable, so that other elements, such as, for example, casings, can also be positioned.

Because of the chosen design of the setback, it is possible to suspend the drill string elements in the setback. In other words, the drill string elements that have been placed in the setback are not subjected to collapsing loads. That means that relatively long drill string elements can be placed in the setback according to the invention. Owing to the fact that the elements are suspended, they do not rest on the couplings placed at each end of a drill string. The storage in the setback therefore ensures that the couplings cannot be damaged.

According to the invention, it is advantageous for the piperacker to have a stationary, substantially vertical rotary shaft, on which two or more hinged arms are fixed, each provided on the ends with a gripping element for gripping an element such as a multi-joint, which hinged arms are movable from a folded-in position near the rotary shaft of the piperacker to a folded-out position at a distance from the rotary shaft, for manipulating a clamped drilling element relative to the rotary shaft of the piperacker by means of the folding-in or folding-out movement, characterized in that the gripping element of the bottom hinged arm is in the form of a clamping element for clamping a drilling element such as a multi-joint, and the bottom hinged arm is fitted on the rotary shaft in such a way that it is movable in the vertical direction, the gripping element on the top hinged arm being in the form of a guide element for guiding a drilling element along it in the vertical direction.

Piperackers are known in the prior art. However, it is possible with the piperacker according to the invention to move the drilling elements clamped in the piperacker over a relatively great distance in the vertical direction. Only the gripping element of the bottom-hinged arm grips the outside of a drilling element. The gripping elements of the top arm are used only for guiding a drilling element. If the bottom hinged arm is subsequently moved in its entirety in the vertical direction relative to the axis of rotation, a clamped drilling element will follow the vertical movement of the hinged arm. This ensures that the elements can be moved over a great distance. This great vertical movement is not possible by means of the piperackers according to the prior art.

It is possible according to the invention for the piperacker to be provided with a first drive for opening and closing the top hinged arm, a second drive for opening and closing a bottom hinged arm, and a third drive for moving the bottom hinged arm in the vertical direction along the rotary shaft.

According to the invention, it is possible for the drilling mast to be provided with a space or cab for accommodating the operator of the drilling mast, the space or cab for accommodating the operator(s) being accommodated in the open space in the mast. It is possible here for the space or the cab for accommodating the operator to be situated above the level of the deck on which the mast is mounted.

On board the vessel there will always have to be room for an operator, who has to operate the hoisting means on the drilling mast. In the prior art it is customary to fix a special operator cab on the deck of the ship. In the first place, this takes up space.

In the second place, it is important for the operator always to have a clear view over the hoisting means on the drilling mast. According to the invention, by accommodating the space for operating the mast in the mast itself, at deck level, it is ensured that the operator always has a clear view of the hoisting means, so that the operator can carry out his work undisturbed.

It is possible according to the invention for a storage area to be present at the underside of the mast, for accommodating equipment that is placed in position during the use of the drilling mast.

During the drilling process many heavy instruments are needed, for example for coupling the drill string elements together during the assembly of a drill string. So-called iron rough necks are used for this task. It is advantageous if these iron rough necks can be stored in the vicinity of the place where they are needed. The underside of the mast provides an excellent storage area for such large, heavy machines.

In the present text, reference is emphatically made to assembling and dismantling a drill string. It must be understood that the disadvantages associated with having to dismantle a drill string into parts also apply to other elements used in the drilling process. An example of this is a casing. This casing is also composed of loose casing parts, which have to be supplied part by part to a casing to be assembled.

A drilling mast 1, which can be placed on a drilling vessel, is shown in FIG. 1. The drilling mast 1 is provided with first lifting means 2. The lifting means allows the drill string to be assembled, in order to be able to drill in the seabed below the drilling vessel. The lifting means 2 can also be used for other drilling operations, such as assembling, for example, a casing. In order to keep the position of the lifting means 2 substantially constant relative to the seabed during the assembly of the drilling mast, or during the drilling, the drilling mast 1 is provided with a heave compensation system. The heave compensation system can compensate for the movements that the ship makes relative to the seabed, as a result of wind, swell and the like.

The winches used for paying out or hauling in the hoisting cables required for the lifting means 2 are accommodated on the inside of the wall of the drilling mast 1. The winches and other facilities do not have to be placed on board the ship giving a considerable space saving. The means that are necessary for the heave compensation, such as, for example, cylinders, are also fitted in the drilling mast 1 itself.

The special feature of the drilling mast 1 according to the invention is that it comprises not only a first position for lifting means 2, but also a second position where the second lifting means 4 can be fitted as shown in FIG. 1. The drilling mast 1 according to the invention is designed in such a way that the mast is of a substantially square shape. The first lifting means 2 and the second lifting means 4 are fixed back to back on the mast. That means that lifting means project on either side of the mast.

The advantage of the presence of second lifting means is apparent particularly during the assembly and dismantling of, for example, the drill string. At the moment of drilling into the ground, the drilling tool fixed on the end of the drill string inevitably becomes blunt. When the drill string is hoisted up, in order to permit changing of the drilling tool, the work of the vessel is irrevocably at a standstill. By now using the first lifting means 2 for dismantling a drill string, it is possible to work simultaneously with the aid of the second lifting means 4, for example in order to assemble a new drill string. A substantial time saving is achieved in this way. The lifting means needed for the second lifting means 4 and also the heave compensation system needed for the second lifting means 4 are also accommodated on the inside of the drilling mast 1. Through the presence of the winches of both the first lifting means 2 and the second lifting means 4 in the drilling mast 1, the winches of the lifting means can be used as mutual backup systems. The same applies to the pneumatic cylinders present for the heave compensation system. That means that only a single backup system need be present, and not a double backup system, which would be needed if two freestanding masts were used.

The term 'work place' is used in the present text. It is intended to indicate the position directly below the first and the second lifting means.

When the various parts such as the winches are being fitted in the mast, a certain amount of space must always be left clear in order to keep the parts accessible, for example for maintenance. If two freestanding masts are used, that access space has to be kept clear for each of the masts, for maintenance and the like. That means that less optimum use can be made of the space in two freestanding masts than is the case according to the present invention, where one large mast is used, so that the space can be arranged very efficiently.

A further advantage of the mast according to the invention is that the mast can be assembled and tested in its entirety. The mast can then be taken ready for use to the place where it is to be used, and placed on a vessel.

In FIG. 1 the winches for hauling in the cables are shown diagrammatically by reference numerals 5, 6 and 7. The heave compensation system 8 is also shown in FIG. 1. A piperacker 50 is shown located beside the drilling mast 1. The functioning of this piperacker 50 will be explained in greater detail throughout this specification.

Due to the layout of the drilling mast 1 according to the invention, a large amount of space is present in the drilling mast. As seen in FIG. 1, the space can be used for accommodating an operator cab 10. The operator cab 10 is provided above the deck 11 of the drilling vessel, so that the operators have a clear view of the deck from the operator cab 10. A storage space 12 is further provided below the operator cab. The storage space can be used to accommodate equipment needed in the drilling process, for example so-called iron rough necks 13.

Figure 2:
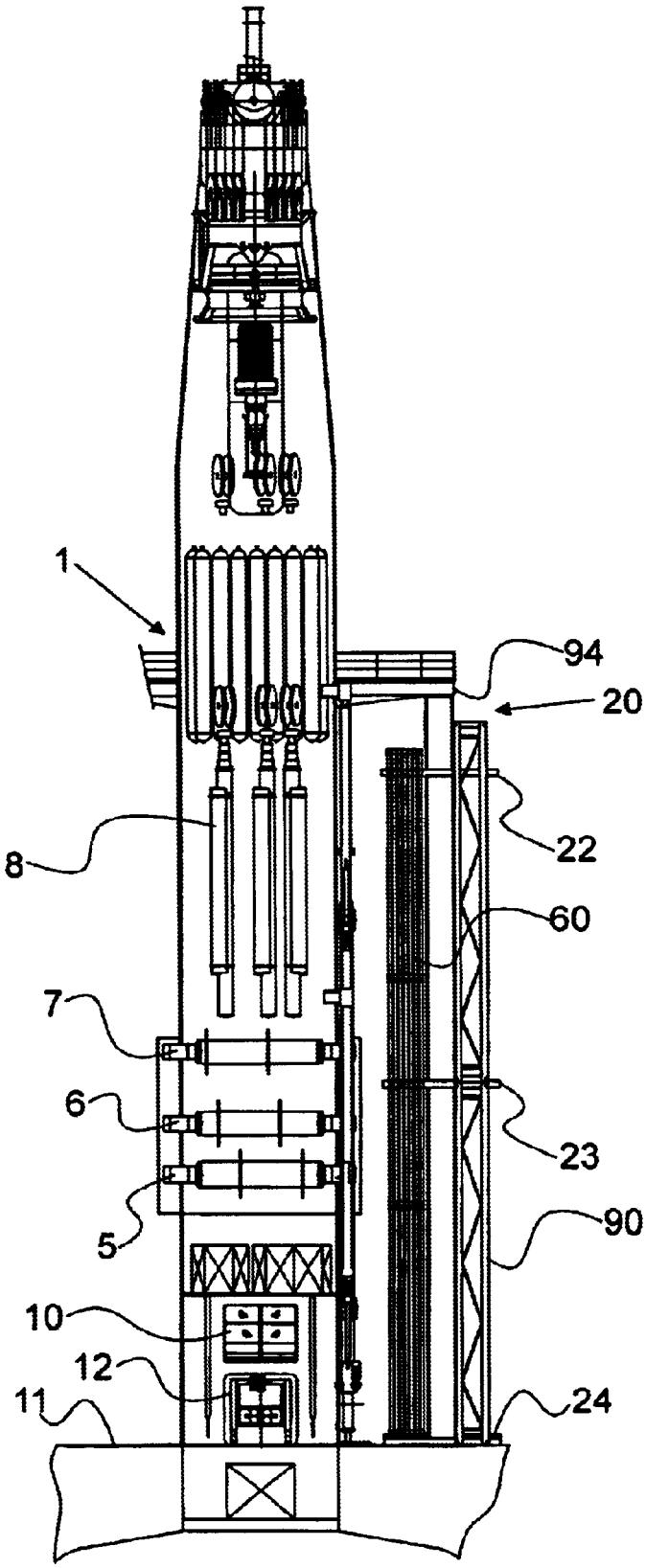
FIG. 2 shows a front view of a drilling mast according to FIG. 1.

FIG. 2 shows a front view of the drilling mast 1 according to FIG. 1. It can be seen in FIG. 2 that a setback 20 has been placed on either side beside the drilling mast 1. The setback 20 is used in the drilling process for temporary storage of a drill string to be assembled. Drill string elements are normally accommodated in a horizontal position on the deck of a vessel. If three of these drill string elements are fixed together, a so-called triple joint is obtained. During the assembly of a drill string, triple joints can be supplied from the setback 20 to a drill string to be assembled. That means that the drill string can be assembled relatively quickly. During the dismantling of the drill string, the drill string elements can be supplied to the setback in parts of three drill string elements, or so-called multi-joints, in each case. It is clear that the setback can also be designed in such a way that parts consisting of four drill string elements can be accommodated in the setback. FIG. 2 also shows the winches 5, 6, 7 used for hauling in the cables. The heave compensation system is shown diagrammatically by reference numeral 108. The triple joints 60 are also shown. The setback 20 comprises a top fingerboard 22, a middle fingerboard 23, and a bottom fingerboard 24. The shape and function of these parts is explained in greater detail with reference to FIG. 4. As also seen in FIG. 1, FIG. 2 shows the space that can be used for accommodating an operator cab 10. A storage space 12 is further provided below the operator cab. The storage space 12 can accommodate equipment needed in the drilling process, for example iron rough necks 13. The operator cab 10 and storage space is provided above the deck 11 of the drilling vessel as shown in FIG. 2. The relative location of a tubular container 90 is also shown.

Figure 3:
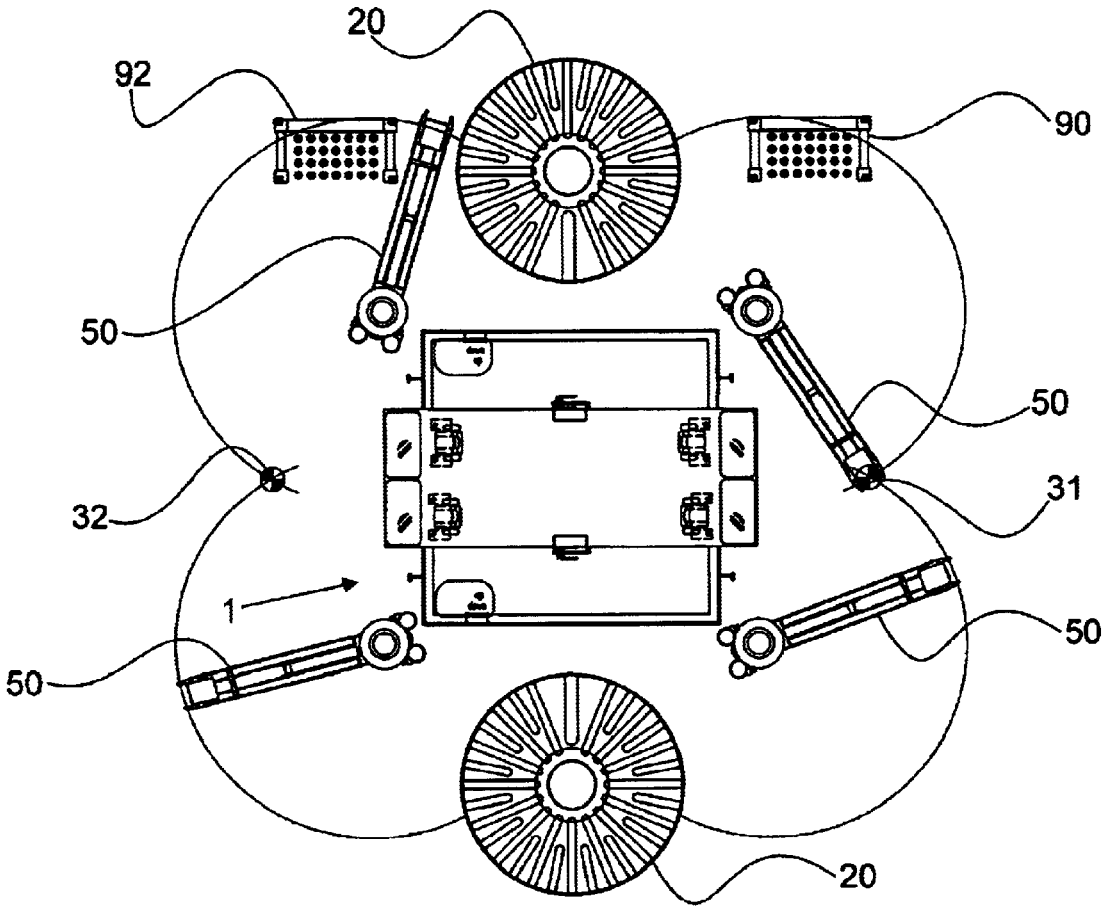
FIG. 3 shows a top view of the drilling mast according to the invention, with set-backs beside it.

FIG. 3 shows a top view of the drill mast 1 according to the present invention. A setback 20 has been placed on either side of the drilling mast 1. In addition, four piperackers 50 have been placed around the drilling mast 1. With the aid of these piperackers 50, elements can be supplied from the work places 31 and 32 respectively to the setback 20. As an alternative, components can be supplied from the setback 20 to the respective work places 31 and 32. The work places 31 and 32 are situated directly below the first and second lifting means of the drilling mast 1. Owing to the fact that the setback 20 is designed as a rotating setback, the position at which the piperacker 50 has to pick up or deliver an element is always the same. That means that the piperacker can also be placed in a stationary position on board a ship. In other words, the piperacker 50 has a stationary rotary shaft 51, about which the piperacker can rotate relative to the deck of the ship. Conventional piperackers are fixed on a rail, because they have to interact with a setback in which the position of the drill string parts to be picked up or delivered will always change. FIG. 3 also shows the relative location of a first tubular container 90 and a second tubular container 92.

The construction of the mast and the interacting piperackers is such that should one of the piperackers 50 fail, the respective work places 31 and 32 are still accessible by means of the other piperackers. The piperackers that are still functioning can remove and supply drill string elements by taking the latter by means of a first piperacker to a first set-back and taking the set-back to the second piperacker, by means of the third piperacker to the fourth piperacker, and by way of the last piperacker again to the next set-back.

Figure 4A:
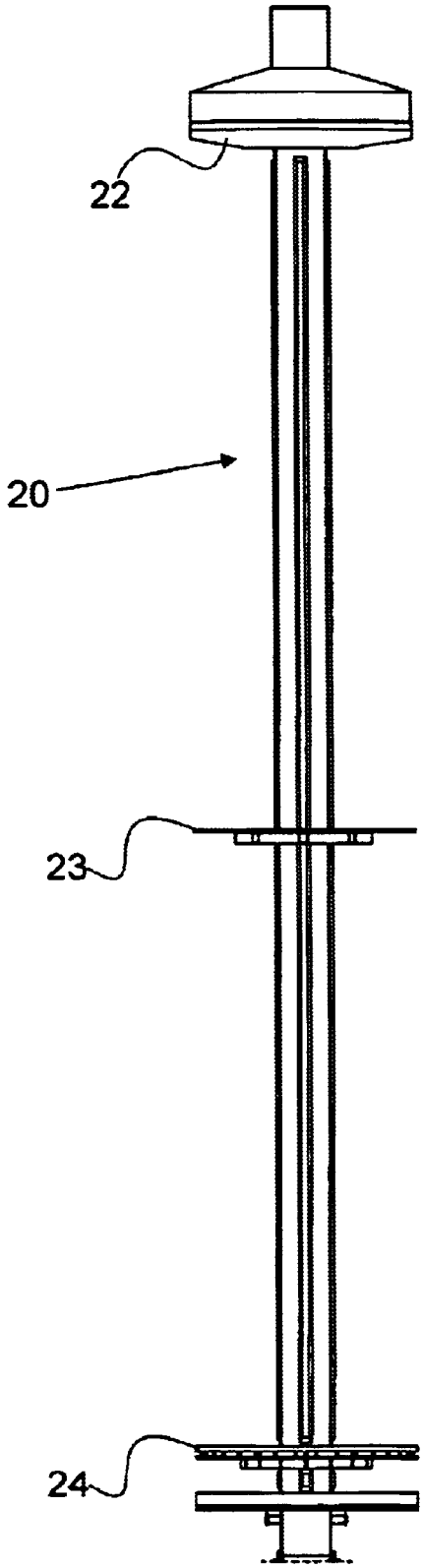
FIG. 4*a* shows a front view of a set-back according to the invention, provided with fingerboards.
Figure 4B:
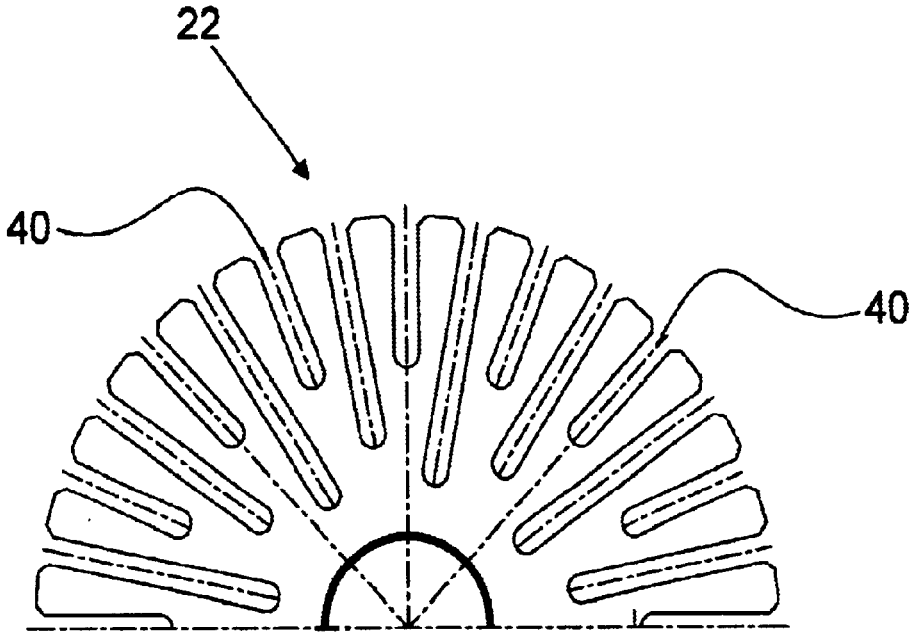
FIG. 4*b* shows a top view of the top fingerboard with openings.
Figure 4C:
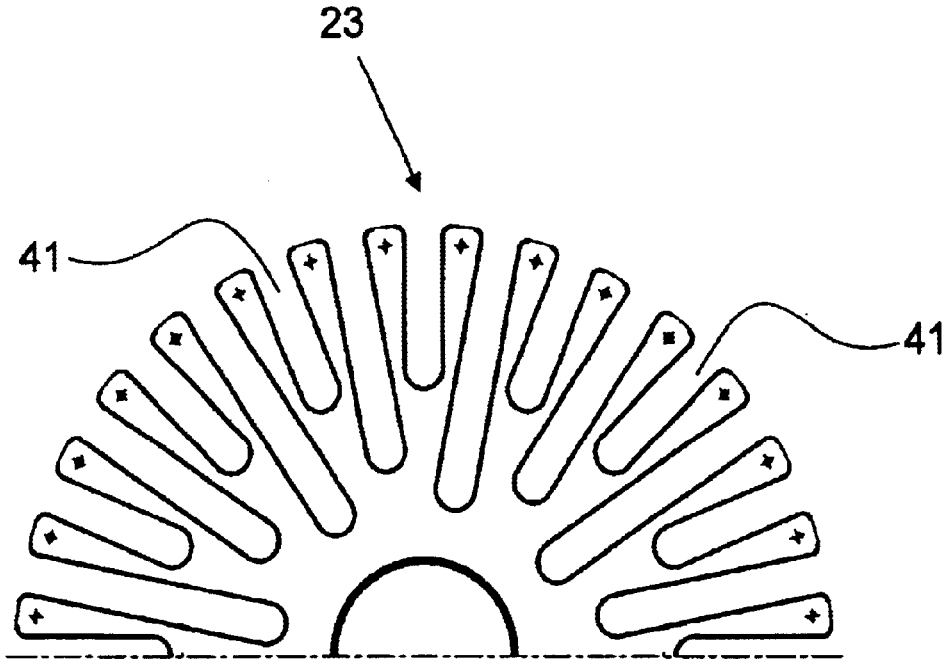
FIG. 4*c* shows a top view of the middle fingerboard with openings.
Figure 4D:
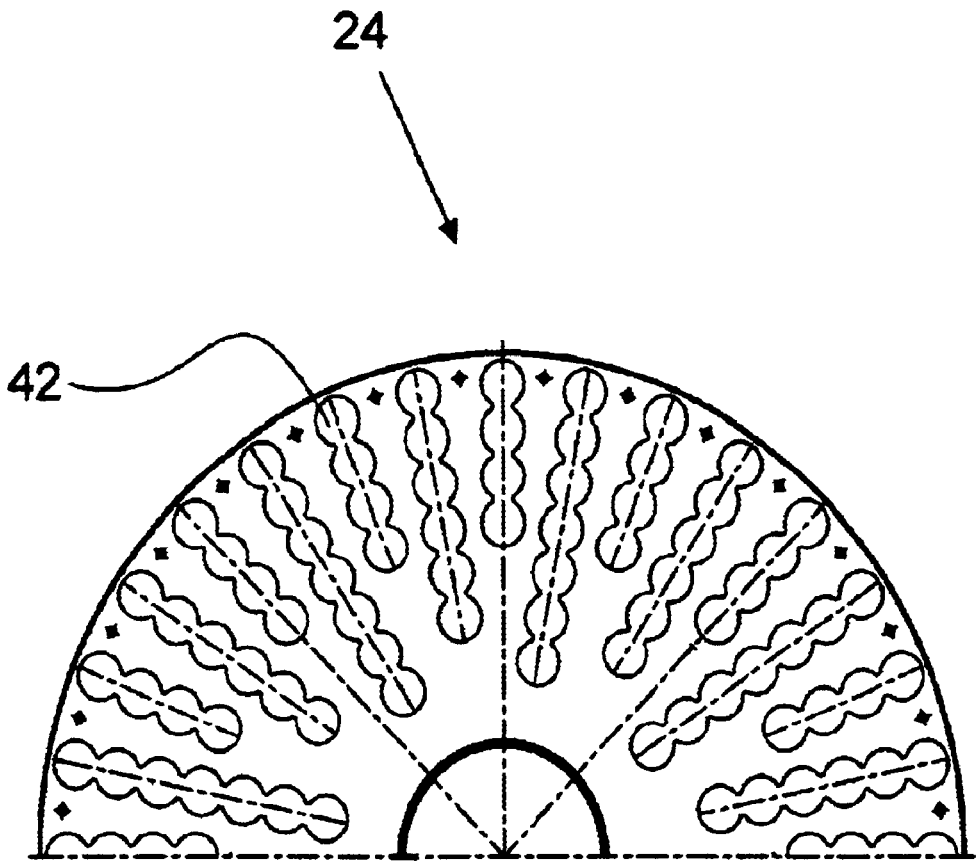
FIG. 4*d* shows a top view of the bottom fingerboard with openings.

A possible embodiment of the rotary setback 20 according to the invention is shown in FIG. 4*a*. FIG. 4*a* shows the relative positions of the top fingerboard 22, middle fingerboard 23, and bottom fingerboard 24. The top fingerboard 22 will be designed with saddle-shaped openings, which are accessible from the outside. In other words, a projecting part of a drill string element can be pushed into the fingerboard from the outside. The moment this projecting part is moved downwards it will become wedged under its own weight in the saddle-shaped opening 40 of the top fingerboard 22 as shown in FIG. 4*b*. The middle fingerboard 23 in the center of the setback 20 is provided with open grooves 41 as shown in FIG. 4*c*. The bottom fingerboard 24 is designed with through holes 42 as shown in FIG. 4*d*. The bottom fingerboard 23 will guide an element to be placed in the setback through fingerboard holes 42. When a drill string element is received in the respective holes 40 and 41 and is then moved downwards, the underside of an element is received in the through hole 42. In other words, a drill string element can be placed in the set-back with the aid of the respective holes 40, 41 and 42, without loose fixing elements being necessary for fixing such an element in the set-back.

Figure 5:
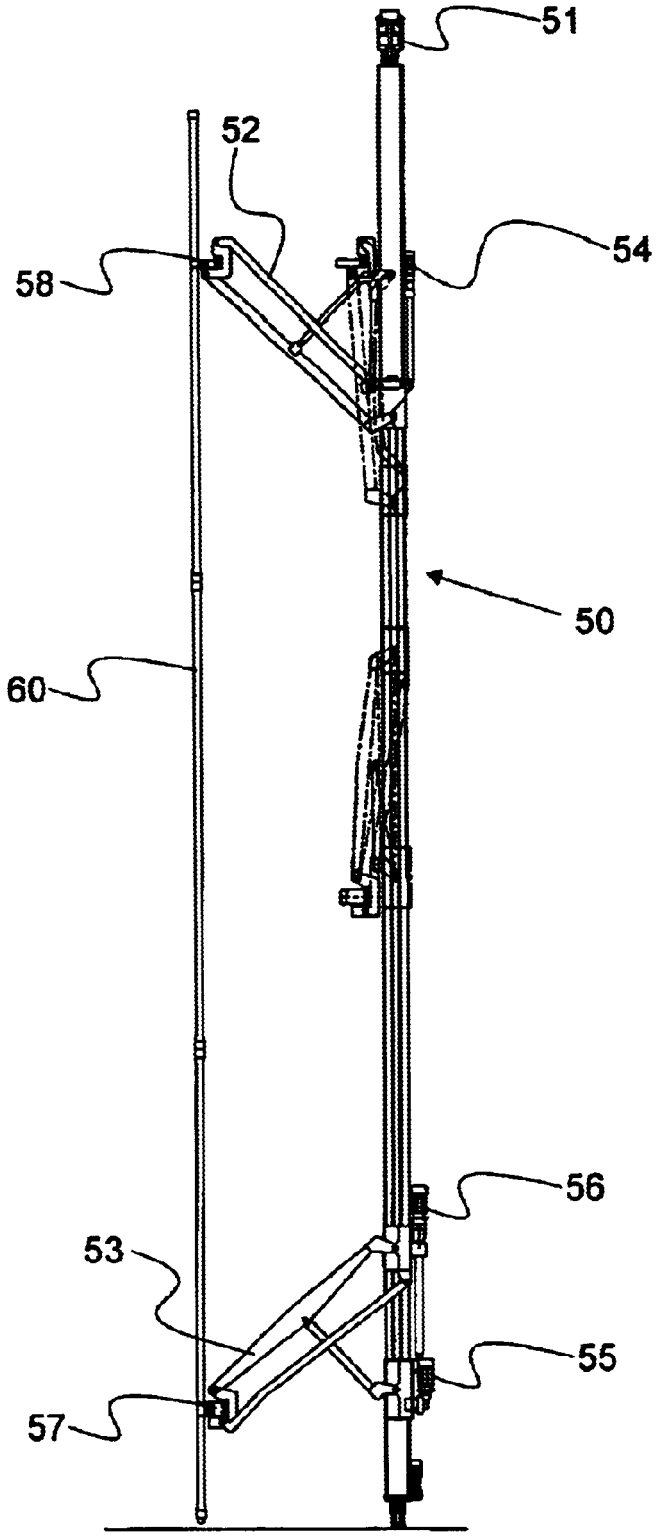
FIG. 5 shows a piperacker according to the invention.

A piperacker according to the invention is illustrated in FIG. 5. The piperacker rotates about a central rotary shaft 51. A top hinged arm 52 and a bottom-hinged arm 53 are fixed on the piperacker 50. The hinged arms can move a clamped drill string element 60 relative to the rotary shaft 51 of the piperacker 50. The top hinged arm 52 can be powered by means of a motor 54. The swinging movement of the bottomhinged arm 53 can be powered in a corresponding way by means of a motor 55. The bottom-hinged arm 53 also has a second motor 56, in order to make the hinged arm 53 move in its entirety in the vertical direction relative to the piperacker 50. The bottom-hinged arm 53 is shown in its top position by dashed lines in FIG. 5. The bottom-hinged arm 53 is provided with a gripping claw 57. The top hinged arm 52 is provided with a guide claw 58. When a drill string element 60 is clamped with the claws 57 and 58 and the motor 56 of the bottom-hinged arm 53 is powered, the element 60 clamped by it will move in the vertical direction. Through this construction, a clamped element can not only move in the horizontal direction by the folding in or folding out respectively of the hinged arms, but can also be moved over a relatively great distance in the vertical direction.

Figure 6:
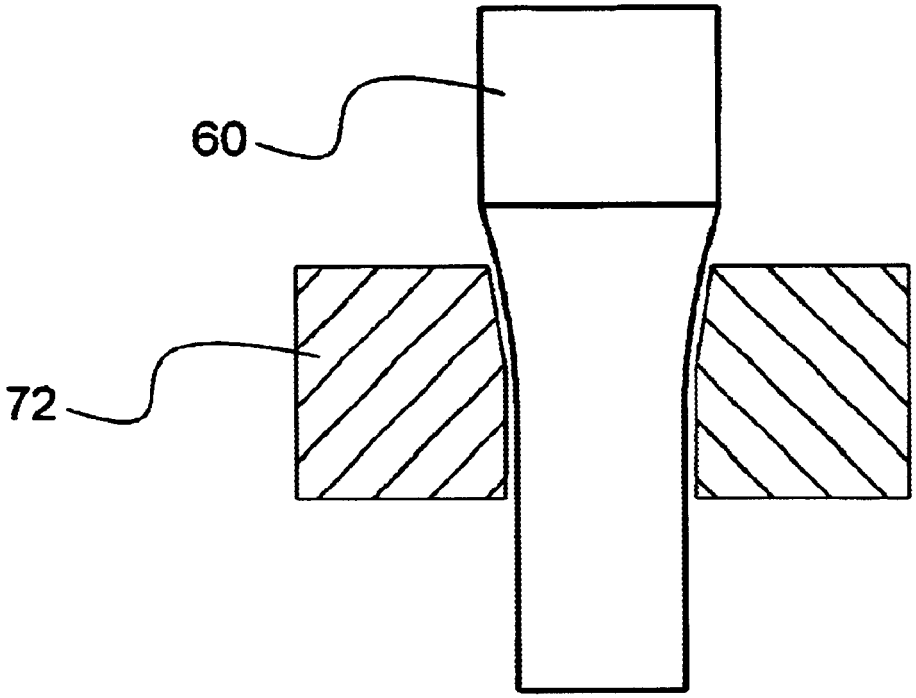
FIG. 6 shows a side view of a triple joint.

FIG. 6 shows side view of a triple joint 60 as it threaded through the top fingerboard 22

The invention is a multiple lift hoist system for a drilling vessel made of a mast having a top side and a base connected to a drilling vessel, wherein the mast is has a hollow construction for supporting a first hoisting device and a second hoisting device at the top side. The lift system also has a first hoisting device located in a first firing line that manipulates a first drill string in a longitudinal direction of the mast and the second hoisting device located in a second firing line that manipulates a second drill string in the longitudinal direction of the mast. Also included are a plurality of cables and a plurality of winches disposed in the hollow construction to manipulate the position of the first hoisting devices and the second hoisting devices relative to the mast so the first firing lines and the second firing lines are accessible from the outside of the mast.

The invention is also a multiple lift hoist system for use on land comprising a mast having a top side and a base connected to land, wherein the mast is has a hollow construction for supporting a first hoisting deice and a second hoisting device at the top side. The lift system also has a first hoisting device located in a first firing line that manipulates a first drill string in a longitudinal direction of the mast, and a second hoisting device located in a second firing line that manipulates a second drill string in the longitudinal direction of the mast. Variation on the invention include a plurality of cables and a plurality of winches disposed in the hollow construction to manipulate the position of the first hoisting devices and the second hoisting devices relative to the mast so the first firing lines and the second firing lines are accessible from the outside of the mast.

The invention contemplates numerous variations to both multiple lift hoist system. The mast can have a quadrangular shape. The first firing line and the second firing line can be located on opposite sides of the mast. Further, a first a second setback and a first and second piperacker can be added besides the mast. The first and second piperacker can also include a third and fourth piperacker disposed beside the mast.

The first setback comprises a shaft in a vertical position. When a placed holder is connected in parallel to the shaft, it rotates about the shaft. The placed holder is made of a pick-up element extending in the horizontal direction from the shaft. The placed holder can also include at least one fingerboard with a closed inner core with fingers projected outward. The first setback can include a top fingerboard with numerous saddle-shaped openings accessible from the outside of the top fingerboard. Like wise, the second setback can include a top fingerboard with a plurality of substantially saddle-shaped openings accessible from the outside of the top fingerboard. The first setback with a top fingerboard can also include a bottom fingerboard that encloses a multi-joint in the openings and can further comprise a middle fingerboard with straight openings accessible from the outside of the middle fingerboard.

Another addition to the first and second piperackers include when the first piperacker has a rotary shaft that is stationary and vertical to the mast and also numerous hinged arms connected to the rotary shaft. Each hinged arm has a gripping element connected to the hinged arm wherein each hinged arm is movable from a folded-in position near the rotary shaft of the first piperacker to a folded-out position a distance away from the rotary shaft. The bottom-hinged arm is fitted on the rotary shaft in such a way that it is movable in a direction parallel to the mast. A top hinged arm is fitted with an element to guide tubulars. Further, the first piperacker can include a first drive for opening and closing the top hinged arm and a second drive for opening and closing the bottom hinged arm. A third drive can be included for moving the bottom-hinged arm in a vertical direction along the rotary shaft.

The mast can accommodate an operator's cabin located inside the mast. Further, the operator's cabin can be located above the level of the deck on which the mast is mounted. The mast can also accommodate a retraction system used to retract equipment from the firing line into the inside of the mast. The retraction system should be located above the level of the deck on which the mast is mounted. A storage area in the mast can be located at the underside of the mast for accommodating equipment that is placed in the firing line. A storage area in the mast can also be located at the upper side of the mast for accommodating equipment that is placed in the firing line during normal operation. The storage area can also include an area to enable personnel to service stored equipment.

The mast can have a modular construction. It is contemplated that the mast of the invention can be between 10 and 30 meters in height.

The drilling vessel in the invention can be a compliant tower, a tension leg platform, a deep draft caisson vessel (or SPAR), or a fixed leg platforms.

The invention is a method for lifting equipment with a multiple lift hoist tower involving connecting a first hoisting device to a first drill string to manipulate a first drill string in a longitudinal direction of the mast and, then, connecting a second hoisting device to a second drill string to manipulate a second drill string in the longitudinal direction of the mast. Next, the method concludes by using a plurality of cables and winches disposed in the hollow construction to manipulate the first hoisting device and the second hoisting device relative to the mast so the first hoisting device and the second hoisting device are accessible from the outside of the mast. The method can include use of between 2 and 6 hoisting devices.

The invention is also a method for installing tubing for a well involving loading loose tubulars in containers and placing the containers on a barge. The containers include a bottom side, a first side, a first end, a second side, a second end, and a tubular support located between the first side and the second side. The tubular support includes numerous connectors attached to each end of the container for lifting and locking containers together. A fingerboard for holding tubulars is located within the container. The method for installing tubing include moving the barge to a drilling rig having a deck, lifting the containers from the barge, and lowering the containers to the drilling rig deck and storing the containers. Further, the method involves moving the containers from the storage area on the drilling rig to the connection area, connecting a first and a second containers together with connectors making a container assembly, and connecting a first tubular in a first container to a second tubular in a second container for each assembly. The method ends by moving the container assemblies to the lifting positions next to the firing line, lifting the container assemblies with the connected tubulars to a vertical position, and removing individual connected tubulars from the container assembly for running into the well using the pipe racking cranes while simultaneously lowering the container assemblies for storage.

What is claimed is:

1. A multiple lift hoist system for a drilling vessel comprising:

a. a mast having a top side and a base connected to a drilling vessel, wherein the mast has a hollow construction for supporting a first hoisting device and a second hoisting device at the top side;

b. the first hoisting device located in a first firing line that manipulates a first drill string in a longitudinal direction of the mast;

c. the second hoisting device located in a second firing line that manipulates a second drill string in the longitudinal direction of the mast; and d. a plurality of cables and a plurality of winches disposed in the hollow construction to manipulate the position of the first hoisting devices and the second hoisting devices relative to the mast so the first firing lines and the second firing lines are accessible from the outside of the mast.

2. The multiple lift hoist system of claim 1, wherein the mast comprises a quadrangular shape.

3. The multiple lift hoist system of claim 1, wherein the first firing line and the second firing line are located on opposite sides of the mast.

4. The multiple lift hoist system of claim 1, wherein the mast accommodates an operator's cabin located inside the mast.

5. The multiple lift hoist system of claim 4, wherein the operator's cabin is located above the level of the deck on which the mast is mounted.

6. The multiple lift hoist system of claim 1, wherein a storage area in the mast is located at the underside of the mast for accommodating equipment that is placed in the firing line during the use of the drilling vessel.

7. The multiple lift hoist system of claim 1, wherein said mast is of modular construction.

8. The multiple lift hoist system of claim 1, wherein the mast is between 10 and 30 meters in height.

9. The multiple lift hoist system of claim 1, wherein a storage area servicing platforms is present to enable personnel to service stored equipment.

10. The multiple lift hoist system of claim 1, wherein the drilling vessel is selected from the following group; a compliant tower, a tension leg platform, a deep draft caisson vessel, and a fixed leg platform.

11. A multiple lift hoist system of for a drilling vessel comprising:

a. a mast having a top side and a base connected to a drilling vessel, wherein the mast is has a hollow construction for supporting a first hoisting device and a second hoisting device at the top side;

b. the first hoisting device located in a first firing line that manipulates a first drill string in a longitudinal direction of the mast;

c. the second hoisting device located in a second firing line that manipulates a second drill string in the longitudinal direction of the mast;

d. a plurality of cables and a plurality of winches disposed in the hollow construction to manipulate the position of the first hoisting devices and the second hoisting devices relative to the mast so the first firing lines and the second firing lines are accessible from the outside of the mast; and e. a first setback and a second setback are disposed besides the mast and a first piperacker and a second piperacker are disposed beside the mast.

12. The multiple lift hoist system of claim 11, further comprising a third piperacker disposed beside the mast and a fourth piperacker disposed beside the mast.

13. The multiple lift hoist system of claim 11, wherein the first set-back comprises:

a. a shaft in a vertical position; and b. a placed holder connected in parallel to the shaft that rotates about the shaft wherein the placed holder comprises of a pick-up element extending in the horizontal direction from the shaft.

14. The multiple lift hoist system of claim 13, wherein the pick-up element comprises at least one fingerboard with a closed inner core with fingers projected outward.

15. The multiple lift hoist system of claim 11, wherein the first setback comprises a top fingerboard with a plurality of saddle-shaped openings accessible from the outside of the top fingerboard.

16. The multiple lift hoist system of claim 11, wherein the second setback comprises a top fingerboard with a plurality of substantially saddle-shaped openings accessible from the outside of the top fingerboard.

17. The multiple lift hoist system of claim 15, wherein the first setback further comprises a bottom fingerboard that encloses a multi-joint in the openings.

18. The multiple lift hoist system of claim 15, wherein the first setback further comprises a middle fingerboard with a plurality of straight openings accessible from the outside of the middle fingerboard.

19. The multiple lift hoist system of claim 11, wherein the first piperacker comprises a. a rotary shaft that is stationary and vertical to the mast;

b. a plurality of hinged arms connected to the rotary shaft;

i. wherein each hinged arm has a gripping element connected to the hinged arm;

ii. wherein each hinged arm is movable from a folded-in position near the rotary shaft of the first piperacker to a fold-out position a distance away from the rotary shaft;

iii. wherein a bottom hinged arm is fitted on the rotary shaft in such a way that it is movable in a direction parallel to the mast;

iv. and a top hinged arm is fitted with an element to guide tubulars.

20. The multiple lift hoist system of claim 11, wherein the first piperacker comprises a. a first drive for opening and closing a top hinged arm;

b. a second drive for opening and closing a bottom hinged arm; and c. a third drive for moving the bottom hinged arm in a vertical direction along a rotary shaft.

21. A multiple lift hoist system for a drilling vessel comprising:

a. a mast having a top side and a base connected to a drilling vessel, wherein the mast is has a hollow construction for supporting a first hoisting devices and a second hoisting device at the top side; wherein the mast accommodates a retraction system to retract equipment from the firing line into the inside of the mast;

b. the first hoisting device located in a first firing line that manipulates a first drill string in a longitudinal direction of the mast;

c. the second hoisting device located in second firing line that manipulates a second drill string in the longitudinal direction of the mast; and d. a plurality of cables and a plurality of winches disposed in the hollow construction to manipulate the position of the first hoisting devices and the second hoisting devices relative to the mast so the first firing lines and the second firing lines are accessible from the outside of the mast.

22. The multiple lift hoist system of claim 21, wherein the retraction system is located above the level of the deck on which the mast is mounted.

23. A multiple lift hoist system for a drilling vessel comprising:

a. a mast having a out side and a base connected to a drilling vessel, wherein the mast is has a hollow construction for supporting a first hoisting device and a second hoisting device at the side;

b. the first hoisting device located in a first firing line that manipulates a first drill string in a longitudinal direction of the mast;

c. the second hoisting device located in a second firing line that manipulates a second drill string in the longitudinal direction of the mast;

d. a plurality of cables and a plurality of winches disposed in the hollow construction to manipulate the position of the first hoisting devices and the second hoisting devices relative to the mast so the first firing lines and the second firing lines are accessible from the outside of the mast; and e. a storage area in the mast is located at the upper side of the mast for accommodating equipment that is placed in the firing line during normal operation of the drilling vessel.

24. A method for lifting equipment with a multiple lift hoist tower comprising:

a. connecting a first hoisting device to a first drill string to manipulate the first drill string in a longitudinal direction of a mast;

b. connecting a second hoisting device to a second drill string to manipulate the second drill string in the longitudinal direction of the mast;

c. using a plurality of cables and winches disposed in a hollow construction to manipulate the first hoisting device and the second hoisting device relative to the mast so the first hoisting device and the second hoisting device are accessible from the outside of the mast.

25. The method of claim 24, wherein between 2 and 6 hoisting devices are used.

26. A multiple lift hoist system for use on land comprising:

a. a mast having a top side and a base connected to land, wherein the mast has a hollow construction for supporting a first hoisting device and a second hoisting device at the top side;

b. the first hoisting device located in a first firing line that manipulates a first drill string in a longitudinal direction of the mast;

c. the second hoisting device located in a second firing line that manipulates a second drill string in the longitudinal direction of the mast; and d. a plurality of cables and a plurality of winches disposed in the hollow construction to manipulate the position of the first hoisting devices and the second hoisting devices relative to the mast so the first firing lines and the second firing lines are accessible from the outside of the mast.

27. The multiple lift hoist system of claim 26, wherein the mast comprises a quadrangular shape.

28. The multiple lift hoist system of claim 26, wherein the first firing line and the second firing line are located on opposite sides of the mast.

29. The multiple lift hoist system of claim 26, wherein the mast accommodates an operator's cabin located inside the mast.

30. The multiple lift hoist system of claim 29, wherein the operator's cabin is located above the level of a deck on which the mast is mounted.

31. The multiple lift hoist system of claim 26, wherein a storage area in the mast is located at the underside of the mast for accommodating equipment that is placed in the firing line during the use of a drilling vessel.

32. The multiple lift hoist system of claim 26, wherein said mast is of modular construction.

33. The multiple lift hoist system of claim 26, wherein the mast is between 10 and 30 meters in height.

34. The multiple lift hoist system of claim 26, wherein a storage area servicing platforms is present to enable personnel to service stored equipment.

35. A multiple lift hoist system for use on land comprising a. a mast having a top side and a base connected to land, wherein the mast has a hollow construction for supporting a first hoisting device and a second hoisting device at the top side;

b. the first hoisting device located in a first firing line that manipulates a first drill string in a longitudinal direction of the mast;

c. the second hoisting device located in a second firing line that manipulates a second drill string in the longitudinal direction of the mast;

d. a plurality of cables and a plurality of winches disposed in the hollow construction to manipulate the position of the first hoisting devices and the second hoisting devices relative to the mast so the first firing lines and the second firing lines are accessible from the outside of the mast; and e. a first setback and a second setback are disposed besides the mast and a first piperacker and a second piperacker are disposed beside the mast.

36. The multiple lift hoist system of claim 35, further comprising a third piperacker disposed beside the mast and a fourth piperacker disposed beside the mast.

37. The multiple lift hoist system of claim 35, wherein the first set-back comprises:

a. a shaft in a vertical position; and b. a placed holder connected in parallel to the shaft that rotates about the shaft wherein the placed holder comprises of a pick-up element extending in the horizontal direction from the shaft.

38. The multiple lift hoist system of claim 37 wherein the pick-up element comprises at least one fingerboard with a closed inner core with fingers projected outward.

39. The multiple lift hoist system of claim 35, wherein the first setback comprises a top fingerboard with a plurality of saddle-shaped openings accessible from the outside of the top fingerboard.

40. The multiple lift hoist system of claim 35, wherein the second setback comprises a top fingerboard with a plurality of substantially saddle-shaped openings accessible from the outside of the top fingerboard.

41. The multiple lift hoist system of claim 39, wherein the first setback further comprises a bottom fingerboard that encloses a multi-joint in the openings.

42. The multiple lift hoist system of claim 39, wherein the first setback further comprises a middle fingerboard with a plurality of straight openings accessible from the outside of the middle fingerboard.

43. The multiple lift hoist system of claim 35, wherein the first piperacker comprises a. a rotary shaft that is stationary and vertical to the mast;

b. a plurality of hinged arms connected to the rotary shaft;

i. wherein each hinged arm has a gripping element connected to the hinged arm;

ii. wherein each hinged arm is movable from a folded-in position near the rotary shaft of the first piperacker to a folded-out position a distance away from the rotary shaft;

iii. wherein a bottom hinged arm is fitted on the rotary shaft in such a way that it is movable in a direction parallel to the mast;

iv. and a top hinged arm is fitted with an element to guide tubulars.

44. The multiple lift hoist system of claim 35, wherein the first piperacker comprises a. a first drive for opening and closing a top hinged arm;

b. a second drive for opening and closing a bottom hinged arm; and c. a third drive for moving the bottom hinged arm in a vertical direction along a rotary shaft.

45. A multiple lift hoist system for use on land comprising:

a. a mast having a top side and a base connected to land, wherein the mast has a hollow construction for supporting a first hoisting device and a second hoisting device at the top side; wherein the mast accommodates a retraction system to retract equipment from the firing line into the inside of the mast;

b. the first hoisting device located in a first firing line that manipulates a first drill string in a longitudinal direction of the mast;

c. the second hoisting device located in a second firing line that manipulates a second drill string in the longitudinal direction of the mast;

d. a plurality of cables and a plurality of winches disposed in the hollow construction to manipulate the position of the first hoisting devices and the second hoisting devices relative to the mast so the first firing lines and the second firing lines are accessible from the outside of the mast.

46. The multiple lift hoist system of claim 45, wherein the retraction system is located above the level of the deck on which the mast is mounted.

47. The multiple lift hoist system of claim 45, wherein a storage area in the mast is located at the upper side of the mast for accommodating equipment that is placed in the firing line during normal operation of a drilling vessel.

* * * * *